US007676252B2

(12) United States Patent
Kayano

(10) Patent No.: US 7,676,252 B2
(45) Date of Patent: Mar. 9, 2010

(54) FILTER CIRCUIT HAVING PLURAL RESONATOR BLOCKS WITH A PHASE ADJUSTMENT UNIT

(75) Inventor: Hiroyuki Kayano, Fujisawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 45 days.

(21) Appl. No.: 11/776,758

(22) Filed: Jul. 12, 2007

(65) Prior Publication Data

US 2008/0068113 A1 Mar. 20, 2008

(30) Foreign Application Priority Data

Sep. 15, 2006 (JP) ..... 2006-251262

(51) Int. Cl.
*H01P 1/20* (2006.01)
*H01B 12/02* (2006.01)

(52) U.S. Cl. ..... 505/210; 333/99 S; 333/202; 333/204

(58) Field of Classification Search ..... 333/202, 333/204, 99 S, 126, 129, 132, 134; 505/210
See application file for complete search history.

(56) References Cited

U.S. PATENT DOCUMENTS

| | | | | |
|---|---|---|---|---|
| 5,097,236 | A * | 3/1992 | Wakino et al. | 333/175 |
| 5,191,305 | A * | 3/1993 | Frost et al. | 333/202 |
| 6,518,854 | B2 | 2/2003 | Kayano et al. | |
| 6,633,208 | B2 | 10/2003 | Salkola et al. | |
| 6,759,930 | B2 | 7/2004 | Kayano et al. | |
| 6,914,497 | B2 | 7/2005 | Sano et al. | |
| 2004/0041635 | A1 | 3/2004 | Sano et al. | |
| 2005/0285701 | A1 | 12/2005 | Kayano et al. | |
| 2007/0001787 | A1 | 1/2007 | Kayano | |

FOREIGN PATENT DOCUMENTS

| | | |
|---|---|---|
| JP | 2001-345601 | 12/2001 |
| JP | 2004-96399 | 3/2004 |

(Continued)

OTHER PUBLICATIONS

Mitsuru Honjoh, et al., "Synthesis of Microwave Circuits by Normal Mode Expansion—Synthesis of Rectangular Waveguide Filter with Dielectric Sheet Window", IEICE Technical Report, MW-82-54, 1982, pp. 9-16.

(Continued)

*Primary Examiner*—Benny Lee
(74) *Attorney, Agent, or Firm*—Oblon, Spivak, McClelland, Maier & Neustadt, L.L.P.

(57) ABSTRACT

A filter circuit includes an input terminal configured to input an input signal; first to ith blocks which have first to ith resonators as transmission lines having first to ith resonance frequencies; a power divider configured to distribute the input signal to the first to ith blocks; a power combiner configured to combine signals which have passed through the first to ith blocks to obtain a combined signal; and an output terminal configured to output the combined signal, wherein a jth block includes a phase adjustment unit which provides a signal of the jth block with a phase difference within a range of {(180±30)+(360×n)} degrees from a signal of a (j+1)th block, and a resonator having a large amount of group delay has a greater line width than a resonator having a small amount of group delay.

5 Claims, 14 Drawing Sheets

FOREIGN PATENT DOCUMENTS

JP 2004-128738 4/2004

OTHER PUBLICATIONS

Takayuki Kato, et al., "Studies on the equivalent circuits of dual-mode rectangular waveguide filters using HFSS and MDS", IEICE Technical Report, MW98-85, 1998, pp. 73-80.

U.S. Appl. No. 12/199,248, filed Aug. 27, 2008, Kayano, et al.

U.S. Appl. No. 12/235,951, filed Sep. 23, 2008, Kayano.

U.S. Appl. No. 11/856,321, filed Sep. 17, 2007, Kayano, et al.

* cited by examiner

FILTER CIRCUIT HAVING PLURAL RESONATOR BLOCKS WITH A PHASE ADJUSTMENT UNIT

CROSS-REFERENCE TO RELATED APPLICATIONS

This application is based upon and claims the benefit of priority from the prior Japanese Patent Applications No. 2006-251262 filed on Sep. 15, 2006, the entire contents of which are incorporated herein by reference.

BACKGROUND OF THE INVENTION

1. Field of the Invention

The present invention relates to a filter circuit, for example, a band limiting filter circuit provided in a posterior stage of a power amplifier in a transmission unit of a radio communication apparatus.

2. Related Art

Conventionally, a filter circuit is constructed by cascade-connecting resonators (resonance circuits) whose conductor part is made of, for example, superconductor. A superconductor has a limit value in a current per unit area that can flow in a superconducting state. An equivalent circuit of a resonator is made up of an inductor and a capacitor and is also provided with a resistor when an effect of loss is considered. A resonance frequency $f_0$ of a resonator when there is no resistor is given by the following expression. "L" and "C" denote inductance and capacitance of the resonator respectively.

$$f0=(L\times C)^{1/2}$$

In this filter circuit, a pass frequency range and an amount of attenuation of a filtering region can be determined by appropriately determining an inter-resonator coupling coefficient which indicates the amount of coupling between resonators and a value of external Q which indicates an amount of excitation for resonators on the input side and the output side.

In such a filter circuit made up of cascade-connected resonators, a current flows through each resonator, that is, a current of all frequency components flows through each resonator, and therefore power handling capability of each resonator needs to be increased. This results in a problem of increasing the size of the circuit. The specification of U.S. Pat. No. 6,633,208 describes that a highest current passes through a first resonator in a cascade connection type filter circuit, and a multi-wavelength structure is adopted for the first resonator (i.e. line length is set to half wavelength×n (n is an integer equal to or greater than 2)) to disperse the current in the resonator.

On the other hand, as another filter circuit, there is a parallel connection type filter circuit made up of resonators connected in parallel whose conductor part is made of superconductor (see, for example, JP-A 2001-345601 (Kokai) and JP-A 2004-96399 (Kokai)). This parallel connection type filter circuit combines signals which pass through resonators having neighboring resonance frequency so as to have phases opposite to each other and thereby realizes a filter characteristic. This filter circuit distributes input power to the respective resonators, and can thereby increase the power handling capability as a whole, yet reduce power handling capability of each resonator compared to a cascade connection type filter circuit and thereby also reduce the circuit scale. However, there is a demand for a further reduction in the circuit scale.

SUMMARY OF THE INVENTION

According to an aspect of the present invention, there is provided with a filter circuit comprising:

an input terminal configured to input an input signal;

first to ith blocks which have first to ith resonators as transmission lines having first to ith resonance frequencies (first resonance frequency<second resonance frequency< . . . <ith resonance frequency);

a power divider configured to distribute the input signal to the first to ith blocks;

a power combiner configured to combine signals which have passed through the first to ith blocks to obtain a combined signal; and an output terminal configured to output the combined signal, wherein a jth block (j is an integer between 1 and i−1) includes a phase adjustment unit which provides a signal of the jth block with a phase difference within a range of {(180±30)+(360×n)} degrees (n is an integer equal to or greater than 0) from a signal of a (j+1)th block, and a resonator having a large amount of group delay has a greater line width than a resonator having a small amount of group delay.

According to an aspect of the present invention, there is provided with a filter circuit comprising:

an input terminal configured to input an input signal;

first to ith blocks which have first to ith resonators as transmission lines having first to ith resonance frequencies (first resonance frequency<second resonance frequency< . . . <ith frequency);

a power divider configured to distribute the input signal to the first to ith blocks;

a power combiner configured to combine signals which have passed through the first to ith blocks to obtain a combined signal; and an output terminal configured to output the combined signal, wherein a jth block (j is an integer between 1 and i−1) includes a phase adjustment unit which provides a signal of the jth block with a phase difference within a range of {(180±30)+(360×n)} degrees (n is an integer equal to or greater than 0) from a signal of a (j+1)th block, and when the line length of the resonator having a large amount of group delay is $Nd_1$ times a half wavelength at the resonance frequency and the line length of the resonator having a small amount of group delay is $Nd_2$ times a half wavelength at the resonance frequency, $Nd_1$ and $Nd_2$ have a relationship of $Nd_1>Nd_2$ ($Nd_1$ is an integer equal to or greater than 2, $Nd_2$ is an integer equal to or greater than 1).

According to an aspect of the present invention, there is provided with a filter circuit comprising:

an input terminal configured to input an input signal;

first to ith blocks which have first to ith resonators as transmission lines having first to ith resonance frequencies (first resonance frequency<second resonance frequency< . . . <ith resonance frequency);

a power divider configured to distribute the input signal to the first to ith blocks;

a power combiner configured to combine signals which have passed through the first to ith blocks to obtain a combined signal; and an output terminal configured to output the combined signal, wherein a jth block (j is an integer between 1 and i−1) includes a phase adjustment unit which provides a signal of the jth block with a phase difference within a range of {(180±30)+(360×n)} degrees (n is an integer equal to or greater than 0) from a signal of a (j+1)th block, a resonator having a large amount of group delay has a greater line width than a resonator having a small amount of group delay, and when the line length of the resonator having a large amount of group delay is $Nd_1$ times a half wavelength at the resonance frequency and the line length of the resonator having a small amount of group delay is $Nd_2$ times a half wavelength at the resonance frequency, $Nd_1$ and $Nd_2$ have a relationship of $Nd_1>Nd_2$ ($Nd_1$ is an integer equal to or greater than 2, $Nd_2$ is an integer equal to or greater than 1).

DETAILED DESCRIPTION OF THE INVENTION

Figure 1:
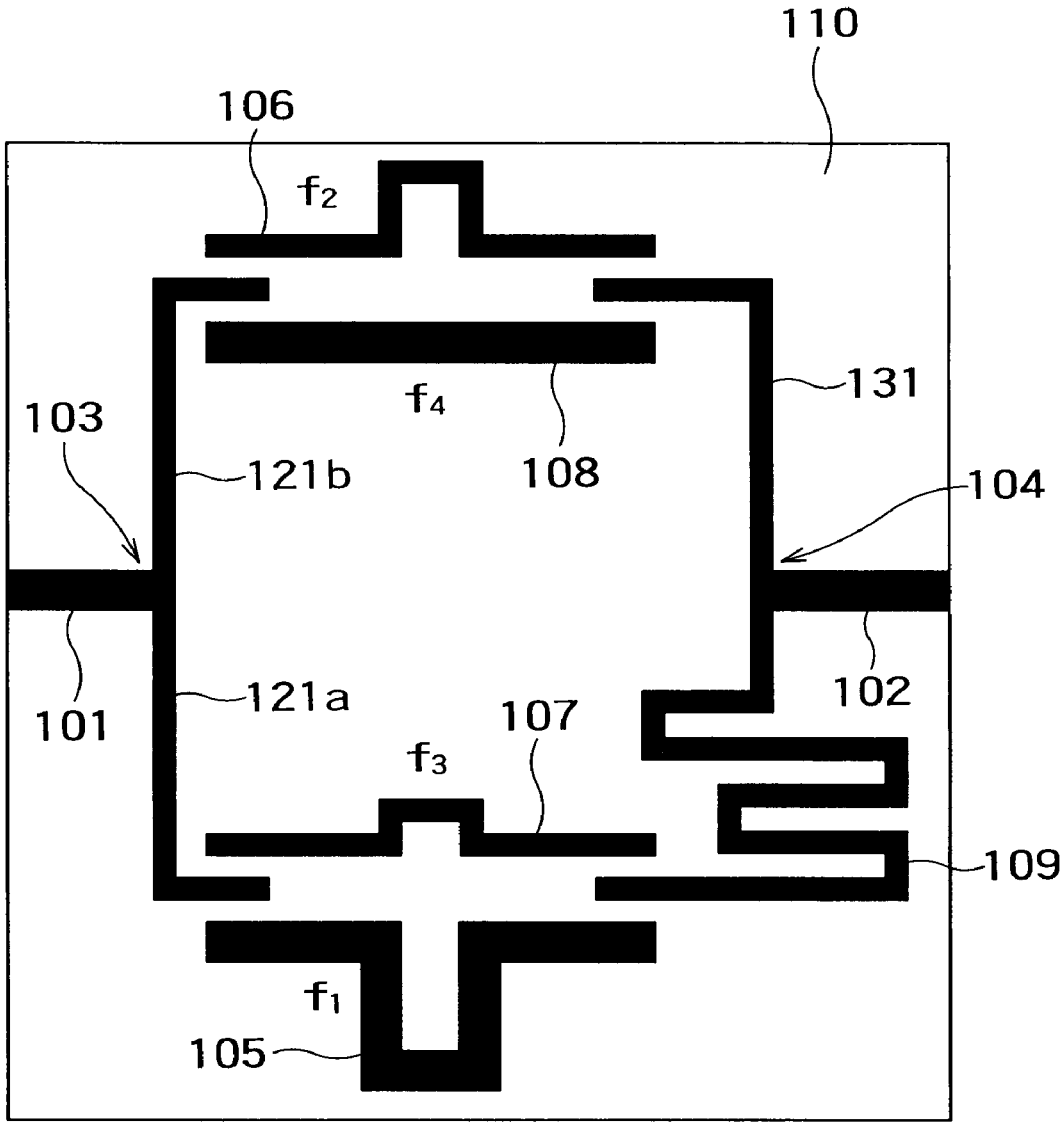
FIG. 1 is a plan layout diagram showing a first embodiment of a filter circuit of the present invention.

In the drawings like reference numerals designate identical or corresponding parts throughout the several views. FIG. 1 is a plan layout diagram showing a first embodiment of the filter circuit according to the present invention.

FIG. 1 shows a microstrip line type filter circuit. A conductor strip is formed in a pattern as shown in the figure on the surface of a dielectric substrate 110 (e.g., sapphire substrate, MGO substrate) and a ground conductor is formed over the entire back surface of the dielectric substrate 110. The conductor and the ground conductor (conductor part of the microstrip line type filter circuit) are made of a material having a limit value in a current per unit area that can flow in a superconducting state, for example, superconductor. This filter circuit is incorporated in, for example, a freezer. An example of the microstrip line type filter circuit is shown here, but it is also possible to apply the present invention to other type filter circuits such as a coplanar line type.

The power of a signal inputted from an input line 101 is distributed to a first signal and a second signal by a power distributor 103. The first signal is transmitted to resonators 105 and 107 configured as transmission lines (microstrip lines) via a line 121*a*. The second signal is transmitted to resonators 106 and 108 configured as transmission lines (microstrip lines) via a line 121*b*. The joint between the input line 101 and the lines 121*a* and 121*b* corresponds to the power distributor 103. The resonators 105, 106, 107 and 108 have corresponding resonance frequencies of f1, f2, f3 and f4. Suppose these resonance frequencies have a relationship of f1<f2<f3<f4. That is, the resonators 105, 106, 107 and 108 resonate at resonance frequencies different from each other. External Q of the resonators 105 and 108 at both ends of the filter band (pass band) (suppose the external Q is the same on the input side and on the output side of the resonator here for simplicity of explanation, but the present invention also naturally includes a case where they are different) is set to be greater than that of the resonators 106 and 107 on the center side (the amount of group delay of the resonators 105 and 108 is greater than that of the resonators 106 and 107), and for this reason, the line widths of the resonators 105 and 108 are set to be greater than those of the resonators 106 and 107 to increase the power handling capability of the resonators 105 and 108. The resonance frequency of a resonator can be measured by placing a probe for detecting radio wave close to the upper part of the resonator and measuring the return loss characteristic of a network analyzer. This makes it possible to arrange a resonator using a wide line to an end of the filter band. The amount of group delay of resonators can also be measured through measurement using a network analyzer likewise.

The signal which has passed through the resonators 106 and 108 having resonance frequencies f2 and f4 is given to a power combiner 104 via a line 131. The signal which has passed through the resonators 105 and 107 having resonance frequencies f1 and f3 is given to the power combiner 104 via a delay circuit (line) 109 which has an electric length of approximately 180 degrees at a center frequency of the filter circuit. This delay circuit 109 realizes a phase difference of 180 degrees at a point of combination between the signal which has passed through the resonators 105 and 107 having resonance frequencies f1 and f3 and the signal which has passed through the resonators 106 and 108 having resonance frequencies f2 and f4. That is, the delay circuit 109 realizes a phase difference of 180 degrees (opposite phases) between the signals which have passed through the resonators of neighboring resonance frequencies. As will be described later, the neighboring signals may have substantially opposite phases, if not completely opposite phases, that is, a phase difference within a range of (180±30)+360×n degrees (n is an integer equal to or greater than 0). The amount of delay by the delay circuit 109 can be determined by adjusting the arrangement relationship between the resonators 105, 107 and delay circuit 109 (for example, length of the parts parallel to each other or distance from each other).

The power combiner 104 combines power of the signals given from the resonators 105 to 108, acquires a combined signal and outputs the combined signal from an output line 102. The joint between the output line 102 and lines 131, 109 corresponds to the power combiner 104.

Impedance matching when performing signal distribution at the power distributor 103 and signal combination at the power combiner 104 can be realized by making up a matching circuit using an impedance conversion circuit with a changed line width and elements L and C. That is, impedance matching is realized in the case of distribution by adjusting the width of the input line 101 and the widths of the two lines 121*a* and 121*b* which branch from the input line 101. On the other hand, impedance matching is realized in the case of combination by adjusting the width of the output line 102 and the widths of the two lines 109 and 131 leading to the output line 102.

Figure 2:
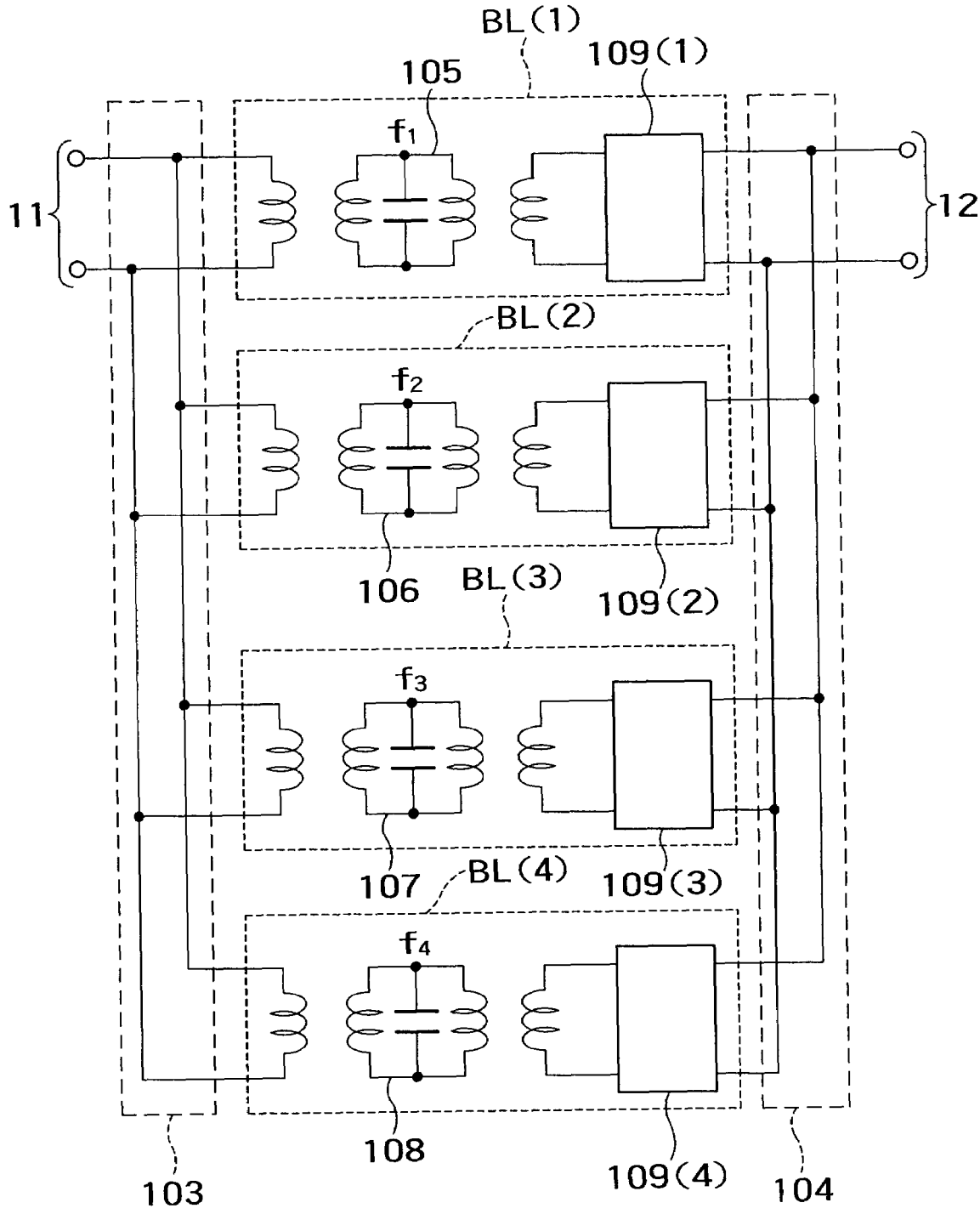
FIG. 2 is an equivalent circuit diagram of the embodiment shown in FIG. 1.

An equivalent circuit of the filter circuit in FIG. 1 is shown in FIG. 2. The elements in FIG. 2 corresponding to the elements shown in FIG. 1 are assigned the same reference numerals.

An input terminal 11 corresponds to the part of the input line 101 which combines the lines 121*a* and 121*b* in FIG. 1. An output terminal 12 corresponds to the part of the output line 102 which combines the lines 131 and 109 in FIG. 1.

A power divider 103 is combined with resonators 105, 106, 107 and 108 and the resonators 105 to 108 are cascade-connected with phase adjustment units 109(1), 109(2), 109(3) and 109(4).

The cascade-connected resonator 105 and phase adjustment unit 109(1) are referred to as a block BL(1). Likewise, the cascade-connected resonator 106 and phase adjustment unit 109(2) are referred to as a block BL(2). The cascade-connected resonator 107 and the phase adjustment unit 109(3) are referred to as a block BL(3). The cascade-connected resonator 108 and the phase adjustment unit 109(4) are referred to as a block BL(4).

The phase adjustment unit 109(1) is set so as to cause the signal passing through the block BL(1) to have a phase substantially opposite to the phase of the signal passing through the BL(2). The phase adjustment unit 109(2) is set so as to cause the signal passing through the block BL(2) to have a phase substantially opposite to the phase of the signal passing through the BL(3). The phase adjustment unit 109(3) is set so as to cause the signal passing through the block BL(3) to have a phase substantially opposite to the phase of the signal passing through the BL(4). The configuration of FIG. 1 is, for example, equivalent to that in the case where the phase adjustment units 109(2) and 109(4) are set to 0 degrees and the phase adjustment units 109(1) and 109(3) are set to −(180±30) degrees. The phase adjustment units 109(1) and 109(3) correspond to the delay circuit 109 of FIG. 1.

In the filter circuit shown in FIG. 1 and FIG. 2, the aspect that signals passing through resonators of neighboring resonance frequencies are provided with a phase difference between substantially opposite phases and the aspect that the line widths of the resonators 105 and 108 are set to be greater than the line widths of the resonators 106 and 107 will be explained in detail respectively.

First, the aspect that signals passing through resonators of neighboring resonance frequencies are provided with a phase difference between substantially opposite phases will be explained.

Figure 5:
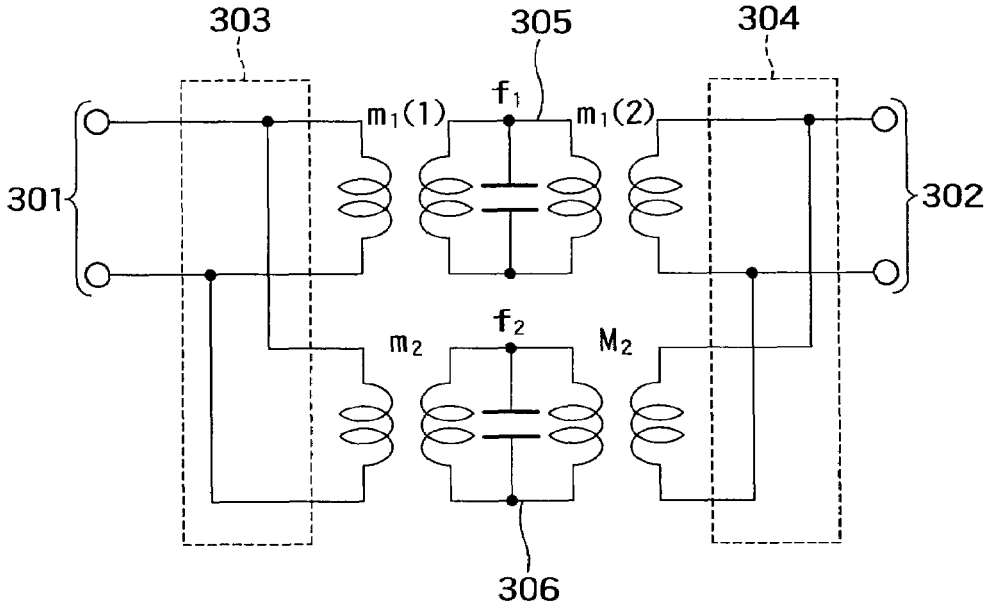
FIG. 5 is a configuration diagram of a filter circuit illustrating the principle of the present invention.

FIG. 5 shows an example of a filter circuit which includes two general resonators. This filter circuit is provided with an input terminal 301, a power divider 303, two resonators (resonance circuits) 305 and 306, a power combiner 304 and an output terminal 302. The resonator 305 has a resonance frequency f1 and the resonator 306 has a resonance frequency f2. Coupling $M_2$ denotes coupling between the resonator 306 and the power combiner 304, $m_1$(1) denotes coupling between the resonator 305 and the power divider 303, $m_1$(2) denotes coupling between the resonator 305 and the power combiner 304 and $m_2$ denotes coupling between the resonator 306 and the power divider 303. Though inductive coupling is shown here, coupling may be any one or both of capacitative coupling and inductive coupling.

Figure 6:
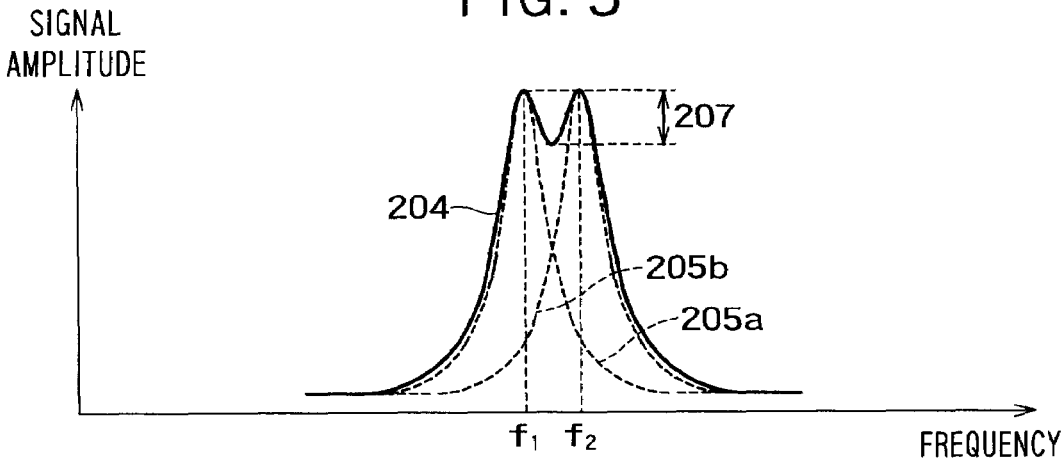
FIG. 6 shows a frequency response characteristic when coupling M2 of the circuit shown in FIG. 5 is negative.

FIG. 6 shows a frequency response versus signal amplitude of the filter circuit in FIG. 5 when it is assumed that coupling $M_2$ is opposite-phase coupling (the phase is reversed by 180 degrees) and $m_1$(1), $m_1$(2) and $m_2$ are in-phase coupling (the phase does not change). Reference numeral 205*a* denotes a frequency response of the resonator 305, 205*b* denotes a frequency response of the resonator 306, 204 denotes a frequency response (combined signal) of the output terminal 302. The frequency response 204 is a frequency response when the output signals of the two resonators 305 and 306 are combined as opposite-phase coupling, which is expressed as the sum of the single frequency responses 205*a* and 205*b* of the two resonators 305 and 306. In this way, a desired frequency response (combined signal) can be obtained by combining the signals which have passed through the two resonators 305 and 306 so as to have phases opposite to each other. An amount of ripple 207 between the resonance frequencies f1 and f2 seen in the frequency response 204 can be adjusted to a desired value by setting the interval between the resonance frequencies f1 and f2, coupling $m_1$(1), $m_1$(2), $m_2$ and $M_2$ of the respective resonators 305 and 306 to appropriate values. Furthermore, when coupling $m_1$(1), $m_1$(2) and $m_2$ are assumed to be opposite-phase coupling, making coupling $M_2$ in-phase coupling causes the signals which have passed through the resonators 305 and 306 to be combined so as to have phases opposite to each other making it possible to realize a combination of sum likewise.

Figure 7:
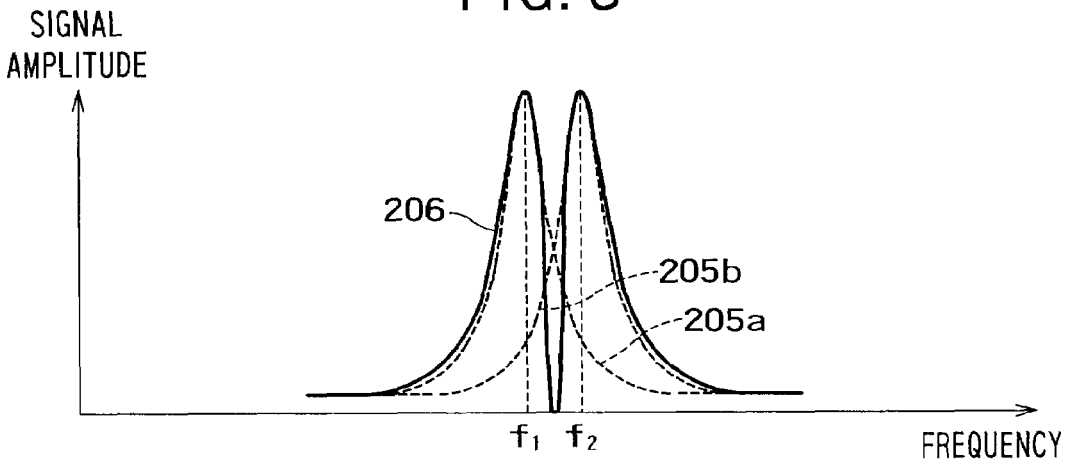
FIG. 7 shows a frequency response characteristic when coupling M2 of the circuit shown in FIG. 5 is positive.

FIG. 7 shows a frequency response versus signal amplitude when coupling $m_1$(1), $m_1$(2) and $m_2$ are assumed to be in-phase coupling and coupling $M_2$ is also assumed to be in-phase coupling. Frequencies $f_1$ and $f_2$ represent resonance frequencies.

Reference numeral 205*a* denotes a frequency response of the resonator 305, 205*b* denotes a frequency response of the resonator 306, 206 denotes a frequency response (combined signal) of the output terminal 302. The frequency response 206 is a frequency response when the output signals of the two resonators 305 and 306 are combined so as to have the same phase, which is expressed as a difference between single frequency responses 205*a* and 205*b* of the two resonators 305 and 306. It is understandable that signal intensity in the vicinity of the center frequency in a target band decreases and it is no longer possible to obtain a desired signal. Thus, a combination of difference results because the phases of signals before and after the respective resonance frequencies of the resonators 305 and 306 are inverted. Even when all coupling $m_1$(1), $m_1$(2), $m_2$ and $M_2$ are assumed to be opposite-phase coupling, a combination of difference results likewise.

In the case of FIG. 6, since the two signals which have passed through the resonators 305 and 306 have phases opposite to each other before being combined, the phase inversion produced in the resonators 305 and 306 is canceled out and a desired signal can be obtained. As described above, when the two signals to be combined have phases substantially opposite to each other if not completely opposite phases, that is, a phase difference within a range of (180±30)+360×n degrees (n is an integer equal to or greater than 0), it is possible to obtain a desired signal.

Based on the above described principle, the filter circuit shown in FIG. 1 is provided with the delay circuit 109 to obtain a desired output signal so that the signals that have passed through the resonators having neighboring resonance frequencies have phases substantially opposite to each other.

Next, the aspect that the line widths of the resonators 105 and 108 in the filter circuit in FIG. 1 are set to be greater than the resonators 106 and 107 will be explained.

Figure 3:
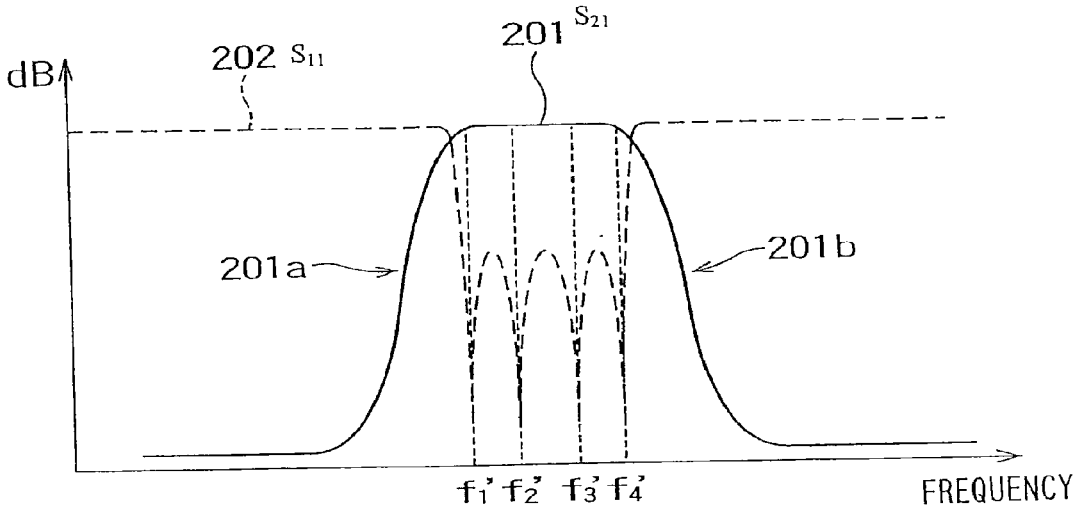
FIG. 3 shows a frequency response characteristic of the embodiment shown in FIG. 1.
Figure 4:
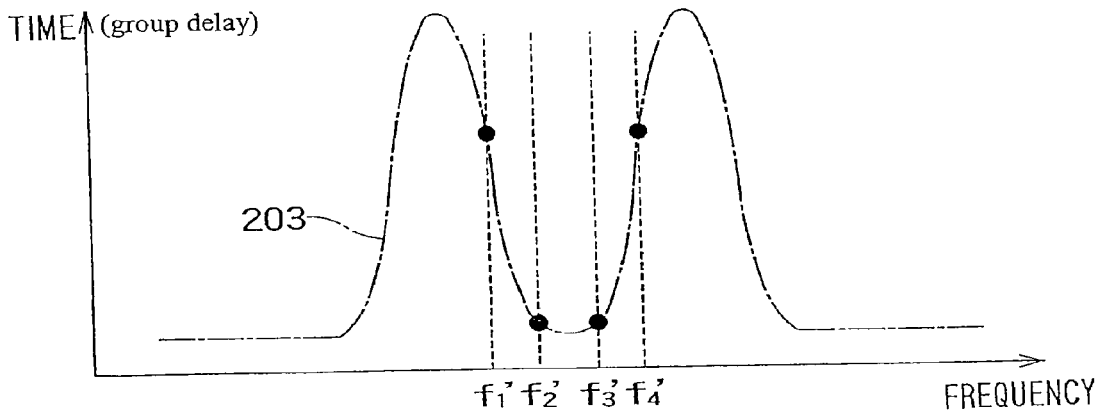
FIG. 4 shows a group delay characteristic of the embodiment shown in FIG. 1.

FIG. 3 and FIG. 4 show frequency characteristics of the filter circuit in FIG. 1. FIG. 3 shows a graph 201 indicating a transmission characteristic ($S_{21}$ characteristic) in dB versus frequency and a graph 202 indicating a return loss characteristic ($S_{11}$ characteristic) and FIG. 4 shows a graph 203 indicating a group delay characteristic in time versus frequency. Group delay is a measure of the transit time of a signal through a device under test, versus frequency. When a combination is performed as the filter characteristic as in FIG. 2, the resonance frequency of each resonator $f_1'$, $f_2'$, $f_3'$ and $f_4'$ does not match the peak position of the return loss characteristic 202 in the strict sense of the word. This is because resonance frequencies are subject to perturbation under the influences of other resonators as a result of the combination of waveforms. However, their order never changes.

To realize a steep skirt characteristic, as described above, the filter circuit in FIG. 1 has greater external Q at both ends of the filter band (suppose the external Q is the same on the input side and on the output side of the resonator here for simplicity of explanation, but the present invention also naturally includes a case where they are different) than the external Q of other resonators. That is, the total of the coupling amount of the resonators with the circuit placed on the input side of the resonator at both ends of the filter band (the coupling amount is defined as the reciprocal of the external Q) and the coupling amount of the resonators with the circuit placed on the output side is smaller than the total of the coupling amount of the other resonators with the circuit placed on the input side of the other resonator and the coupling amount of the other resonators with the circuit placed on the output side. In this way, a higher current is obtained from the resonators at both ends of the filter band (see parts 201*a* and 201*b* in the graph 201 in FIG. 3). That is, when the external Q of the resonator at both ends of the filter band is increased (when the coupling amount is decreased), the amount of group delay at both ends of the filter band increases as shown in FIG. 4 and the value of current that can be extracted also increases in proportion thereto. More specifically, the greater the amount of group delay, the longer the signal stays in the resonator, and therefore the superimposition of waves produces a high current value.

In this way, as a result of the increase in the amount of group delay of the resonators 105 and 108, a high current stays in the resonators 105 and 108, and therefore the resonators 105 and 108 are required to have greater power handling capability than the other resonators 106 and 107. To put it the other way around, the resonators 106 and 107 are required to have not so large power handling capability as the resonators 105 and 108. That is, it is not necessary to increase power handling capability of all the resonators and it is possible to obtain sufficient power handling capability for the filter circuit by increasing power handling capability of only resonators having a large amount of group delay. Focusing on this point, the inventor has implemented a filter circuit with the smallest possible circuit area while maintaining high power handling capability by increasing only the line widths of the resonators 105 and 108 having a large amount of group delay more than the line widths of the other resonators 106 and 107. That is, a filter circuit with a small circuit area having a steep skirt characteristic has been realized.

Hereinafter, the process through which the inventor has come up with the present invention will be explained in detail.

Figure 8:
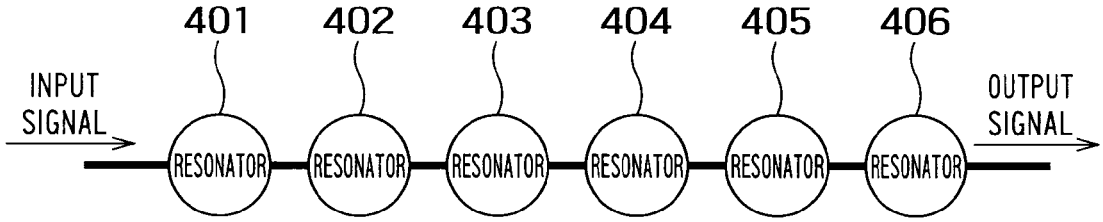
FIG. 8 shows a general cascade connection type filter circuit.
Figure 9:
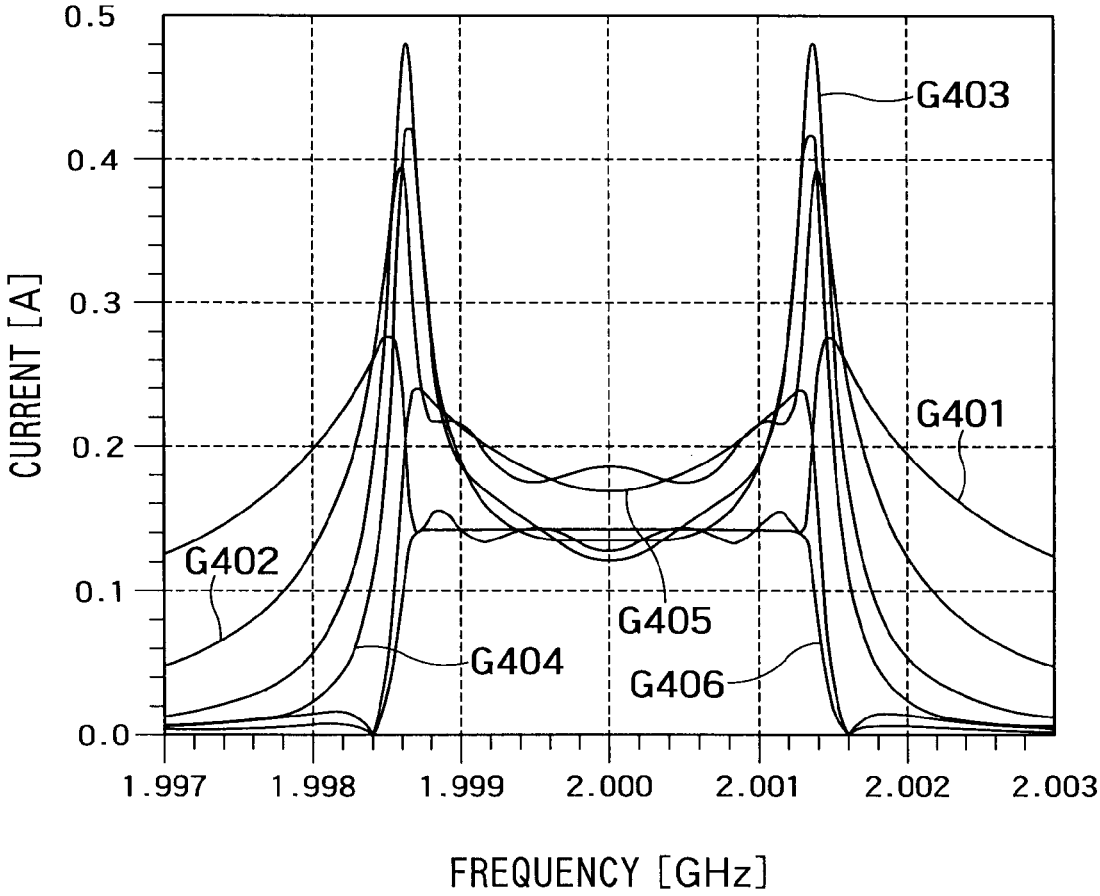
FIG. 9 shows a current distribution of each resonator of the filter circuit in FIG. 8.

FIG. 8 shows the configuration of a general cascade connection type filter circuit. In this filter circuit, six resonators 401 to 406 are cascade-connected with an input signal to resonator 401 and an output signal output from resonator 406. The conductor parts of resonators 401, 402, 403, 404, 405 and 406 are made of superconductor. FIG. 9 shows current (in amps A) values of the respective resonators 401 to 406 in this filter circuit. The current values of the respective resonators 401 to 406 are shown in graphs G401, G402, G403, G404, G405 and G406. The graph in FIG. 9 is obtained through a simulation whereby a signal is inputted to the filter circuit while sequentially changing the frequency of the input signal within the frequency range on the horizontal axis in the figure and the current value of each resonator at a time of each frequency is measured.

As is understandable from FIG. 9, a current in a whole frequency band passes through the respective resonators 401 to 406, and therefore a high current (integral value in the graph) flows through the resonators 401 to 406. The graph G403 shows that the current value of the third resonator 403 becomes a maximum. In order for a high current to flow through the resonators, it is possible to effectively decrease the peak current value by distributing the current over a wider range using a large resonator. However, using a large resonator increases the size of the filter circuit.

Figure 10:
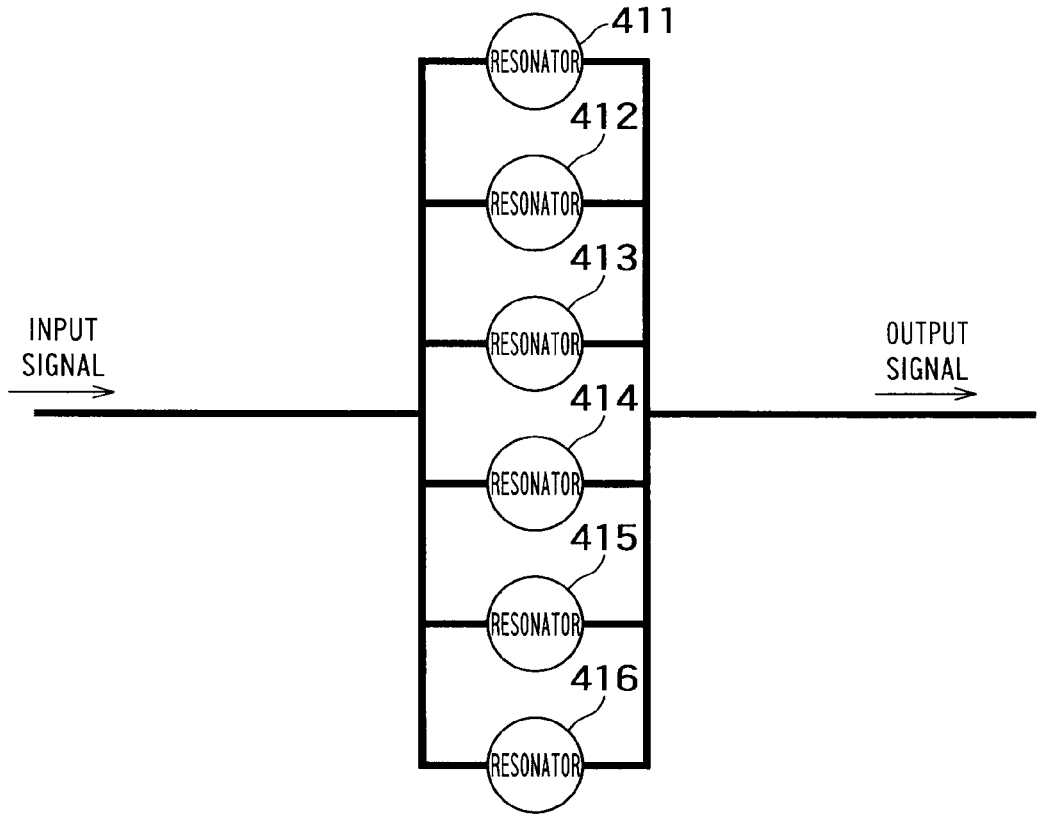
FIG. 10 shows a general parallel connection type filter circuit.
Figure 11:
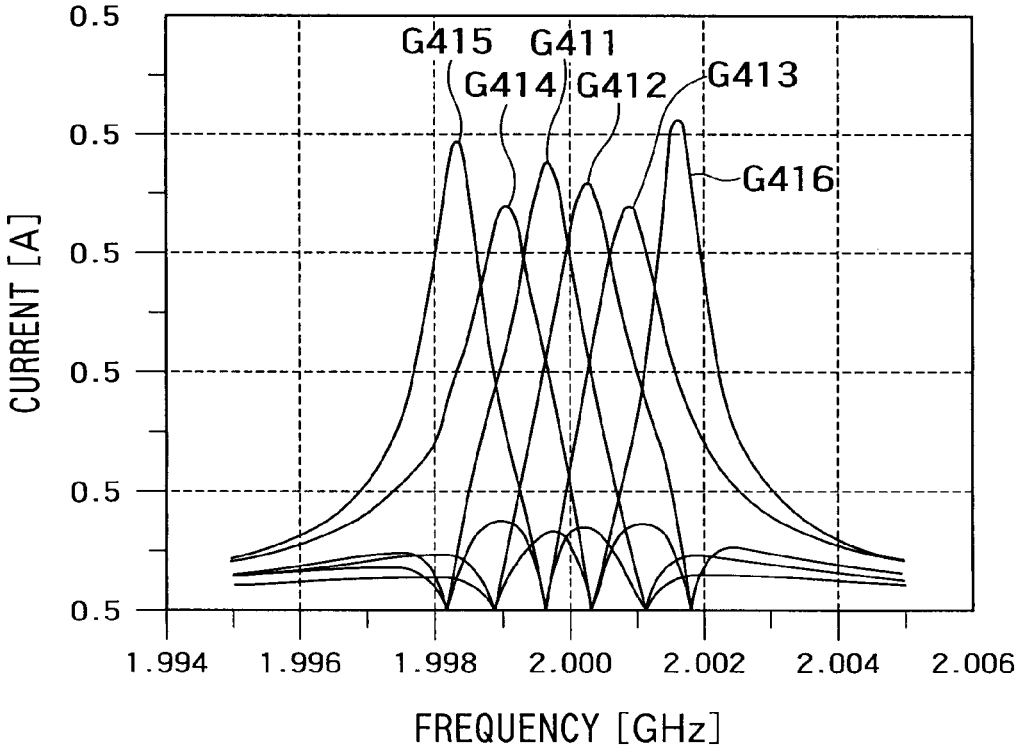
FIG. 11 shows a current distribution of each resonator of the filter circuit in FIG. 10.

FIG. 10 shows the configuration of a general parallel connection type filter circuit having an input signal and an output signal. In this filter circuit, six resonators 411, 412, 413, 414, 415 and 416 are connected in parallel. The conductor parts of the resonators 411, 412, 413, 414, 415 and 416 are made of superconductor. The resonators 411 to 416 have the same power handling capability. The resonators 415 and 416 correspond to both ends of the filter band. FIG. 11 shows current values G411, G412, G413, G414, G415 and G416 of the respective resonators 401 to 406 of this filter circuit. Current values of the respective resonators 411 to 416 are shown in graphs G411 to G416. The current vs. frequency graph in FIG. 11 is obtained through a simulation similar to that in FIG. 9.

Since an input signal is distributed to the resonators 411 to 416, a current (integral value in the graph) which flows through one resonator is smaller than that of the resonator in the cascade connection type filter circuit. Therefore, the power handling capability of each resonator can be made smaller than that of the filter circuit in FIG. 8, and it is thereby possible to reduce the circuit area more in the parallel connection type filter circuit than the cascade connection type filter circuit.

Here, as is understandable from FIG. 11, the current values (G415, G416) of the resonators 415 and 416 at both ends of the filter band in the parallel connection type filter circuit are greater than those of the other resonators 411 to 414. Furthermore, in the parallel connection type filter circuit using superconductor, it is possible to use resonators having different power handling capabilities according to the current valued of the respective resonators. Focusing on this point, the inventor has realized both high power handling capability and downsizing of the filter circuit by increasing the power handling capability using a line of a greater line width for only resonators through which a high current flows.

Figure 12:
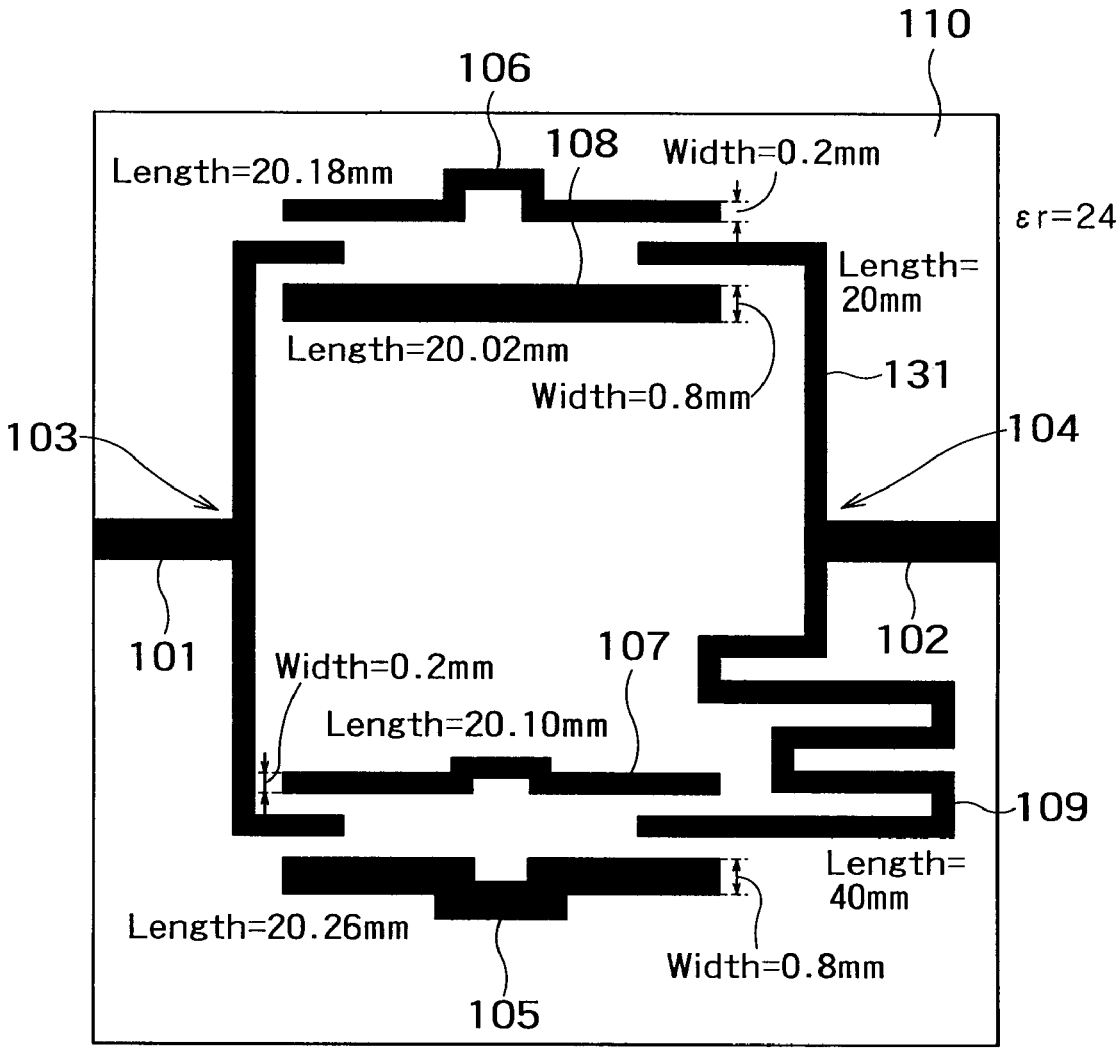
FIG. 12 is a plan layout diagram showing a specific numerical value example of each element shown in FIG. 1.

Here, specific numerical examples of the layout shown in FIG. 1 are shown in FIG. 12.

A dielectric constant Σr of the dielectric substrate 110 is 24. The line length of the resonator 105 is 20.26 mm and the width is 0.8 mm. The line length of the resonator 106 is 20.18 mm and the width is 0.2 mm. The line length of the corresponding resonator 107 is 20.10 mm and the width is 0.2 mm. The line length of the resonator 108 is 20.02 mm and the width is 0.8 mm. Therefore, the widths of the resonators 105 and 108 are 4 times those of the resonators 106 and 107. The line length of the delay circuit 109 is 40 mm. The line length of the line 131 is 20 mm.

Figure 13:
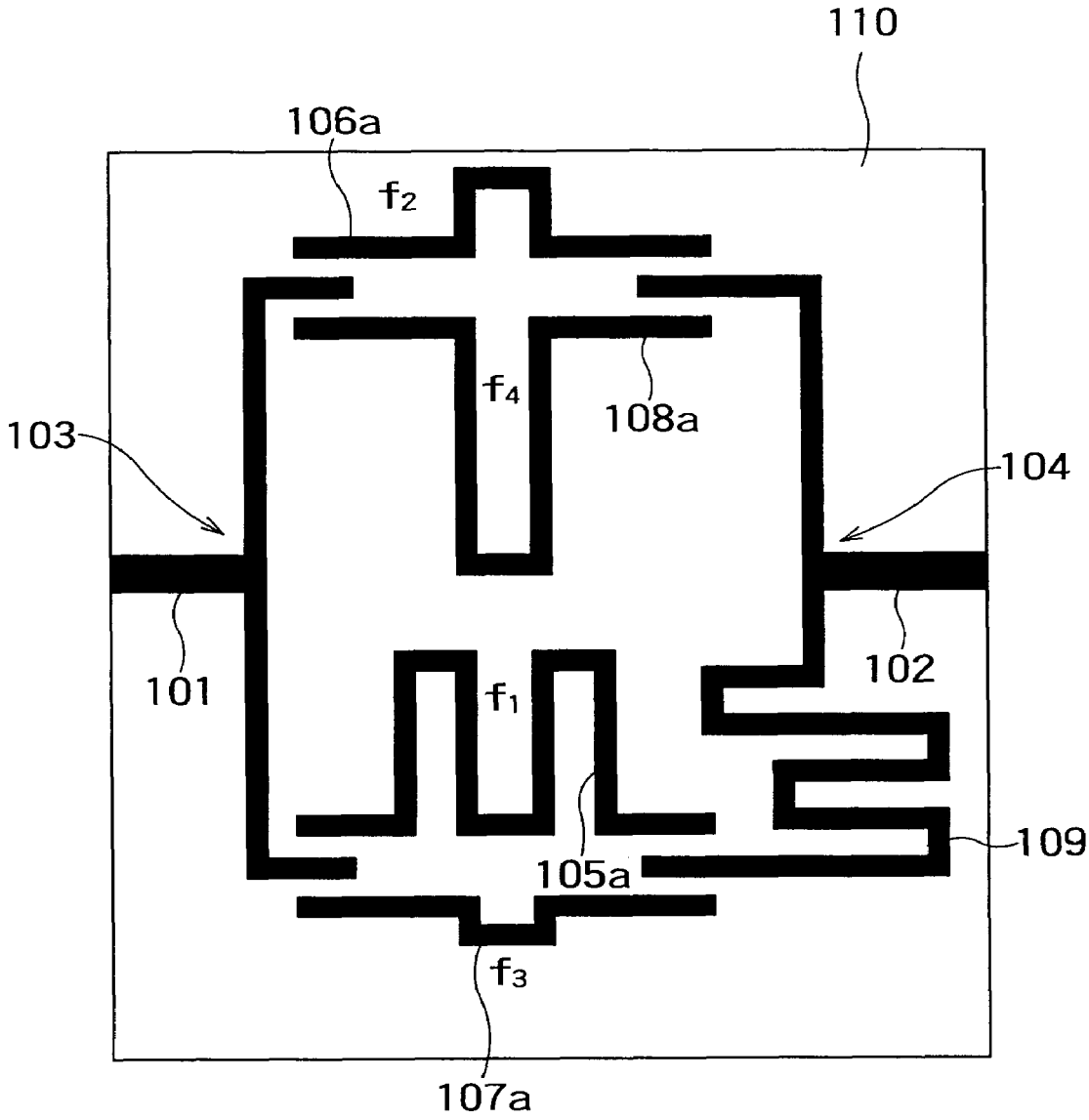
FIG. 13 is a plan layout diagram showing a second embodiment of the filter circuit of the present invention.

FIG. 13 shows a second embodiment of the filter circuit according to the present invention.

This filter circuit is equipped with resonators 105*a*, 106*a*, 107*a* and 108*a* having resonance frequencies f1, f2, f3 and f4. These frequencies have a relationship of f1<f2<f3<f4. The line lengths of the resonators 105*a* and 108*a* having f1 and f4 at the ends of the filter band are set to $Nd_1$ times the half wavelength and the line lengths of the resonators 106*a* and 107*a* having f2 and f3 at the center side of the filter band are set to $Nd_2$ times the half wavelength. Here, $Nd_1>Nd_2$ ($Nd_1$ is an integer equal to or greater than 2, $Nd_2$ is an integer equal to or greater than 1). FIG. 13 shows an example with $Nd_1=2$, $Nd_2=1$. Setting the line lengths of the resonators 105*a* and 108*a* to twice the half wavelength makes it possible to set power handling capability twice that in the case where the line lengths are set to the half wavelength. In the first embodiment, power handling capability has been improved by increasing the line width, but this embodiment improves power handling capability by increasing the line length.

Figure 14:
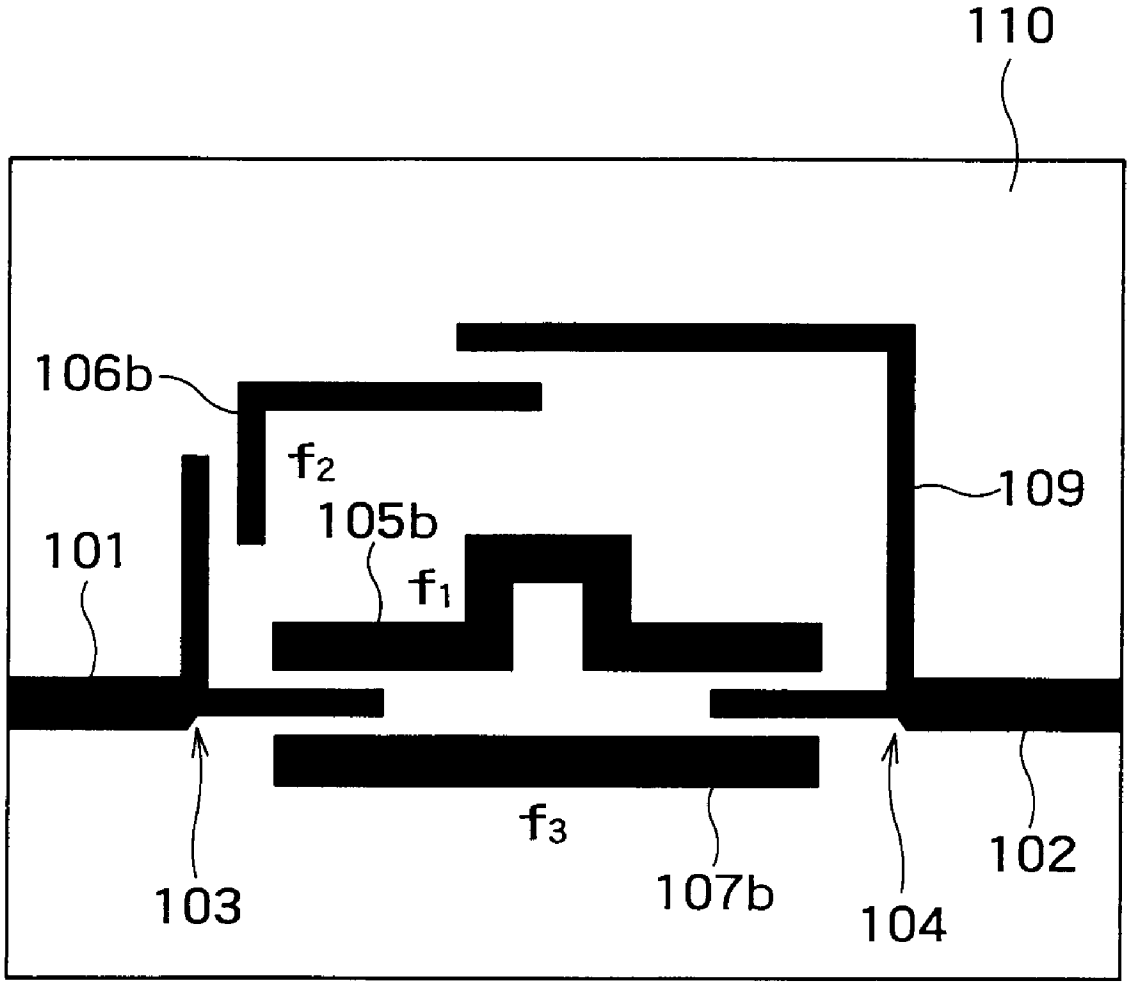
FIG. 14 is a plan layout diagram showing a first modification example of the first embodiment.

FIG. 14 shows a first modification example of the filter circuit according to the first embodiment.

This filter circuit uses resonators 105*b*, 106*b* and 107*b* having corresponding resonance frequencies f1, f2 and f3. These resonance frequencies have a relationship of f1<f2<f3. The line widths of the resonators 105*b* and 107*b* located at both ends of the filter band having a large amount of group delay are set to be greater than the line width of the resonator 106*b* having a smaller amount of group delay and the resonators 105*b* and 107*b* are concentrated on one location. This facilitates the layout design of the filter circuit.

Figure 15:
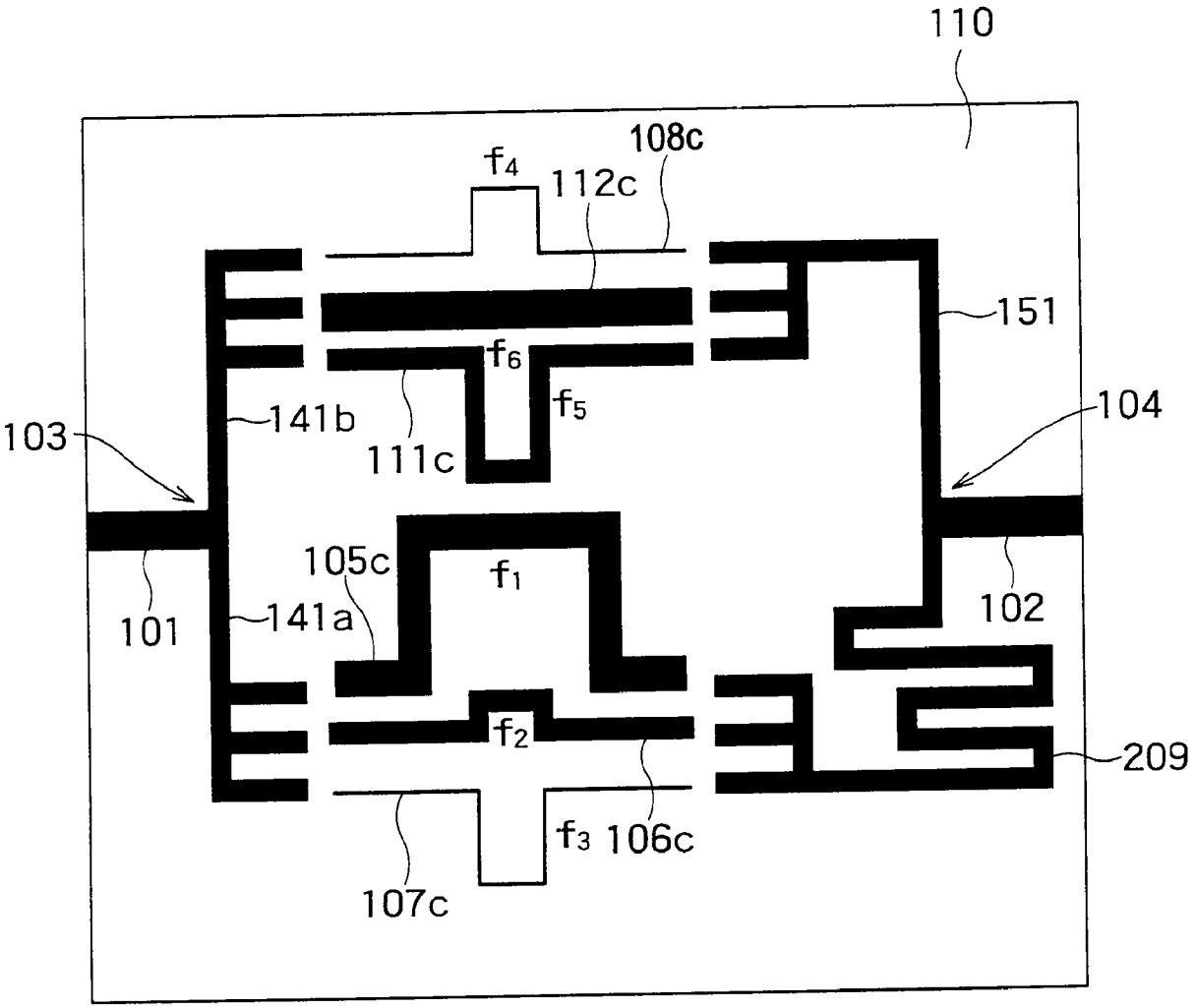
FIG. 15 is a plan layout diagram showing a second modification example of the first embodiment.

FIG. 15 shows a second modification example of the filter circuit of the first embodiment.

This filter circuit uses resonators 105*c*, 106*c*, 107*c*, 108*c*, 111*c* and 112*c* having corresponding resonance frequencies f1, f2, f3, f4, f5 and f6. These resonance frequencies have a relationship of f1<f2<f3<f4<f5<f6. The resonators 105*c* and 112*c* located at both ends of the filter band having a large amount of group delay are assumed to have a first line width, the resonators 107*c* and 108*c* located at the center side of the filter band having a small amount of group delay are assumed to have a second line width which is smaller than the first line width and the resonators 106*c* and 111*c* having a medium amount of group delay are assumed to have a third line width which is smaller than the first line width and greater than the second line width.

Incidentally, in the first embodiment (see FIG. 1), an arrangement in which the resonators 106 and 108 partially face the lines 121*b* and 131 in parallel to each other is adopted in order to couple the resonators 106 and 108 with the lines 121*b* and 131. The same applies to the relationship between the resonators 105 and 107, and lines 121*a* and 109. In contrast, this modification example adopts an arrangement in which the resonators 108*c*, 111*c* and 112*c* face the lines 141*b* and 151 at one end. The same applies to the arrangement between the resonators 105*c*, 106*c*, 107*c* and the lines 141*a* and 209.

Figure 16:
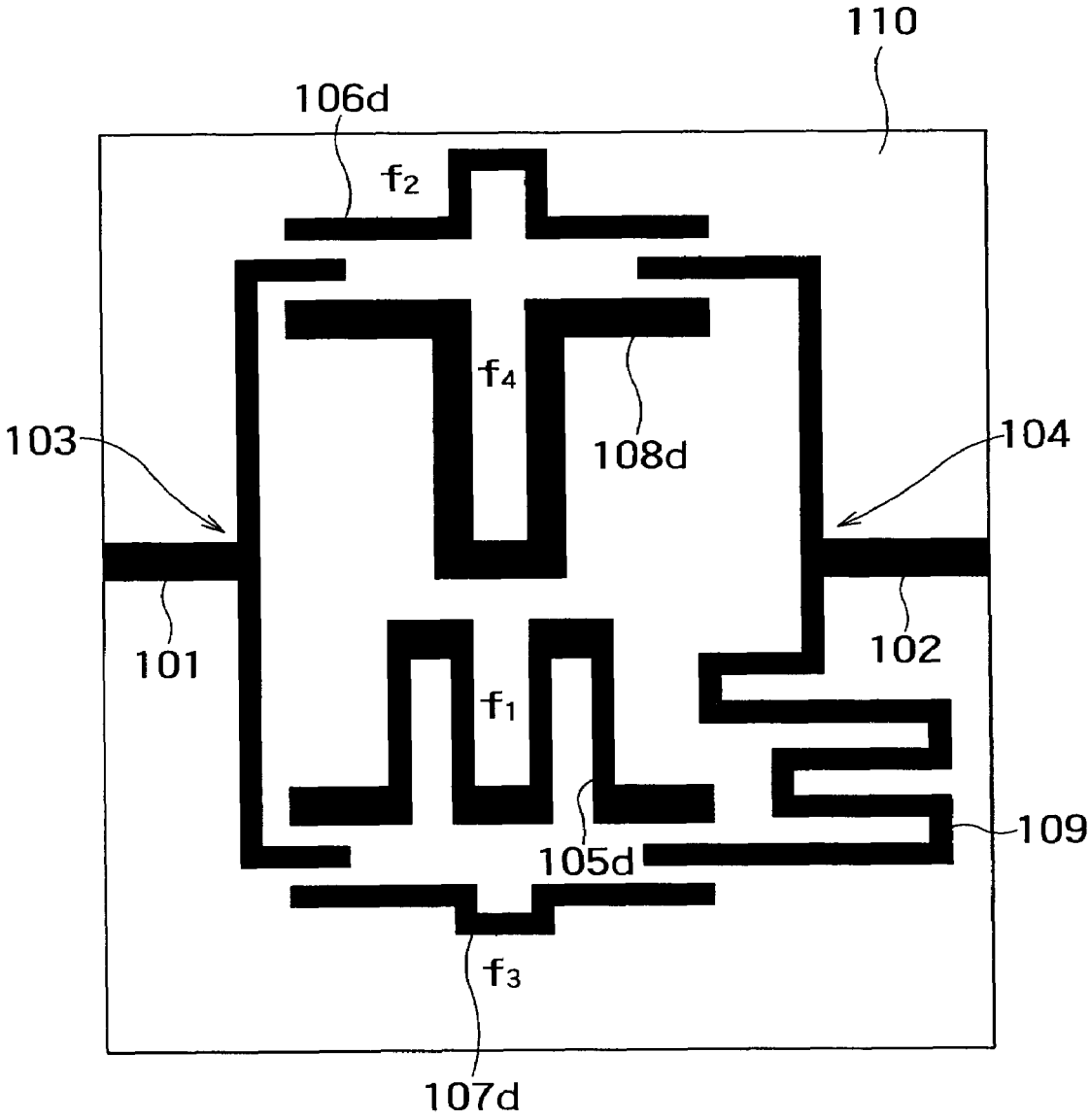
FIG. 16 is a plan layout diagram showing an example combining the first and second embodiments.

FIG. 16 shows an example of combination between the first embodiment and the second embodiment. This shows an example of the filter circuit when both the line width and line length are changed.

This filter circuit uses resonators 105*d*, 106*d*, 107*d* and 108*d* having corresponding resonance frequencies f1, f2, f3 and f4. These resonance frequencies have a relationship of f1<f2<f3<f4. The line widths of the resonators 105*d* and 108*d* located at both ends of the filter band having a large amount of group delay are set to be greater than those of the resonators 106*d* and 107*d* and the line lengths of the resonators 105*d* and 108*d* are set to twice the half wavelength. The line lengths of the resonators 106*d* and 107*d* are half wavelengths.

Figure 17:
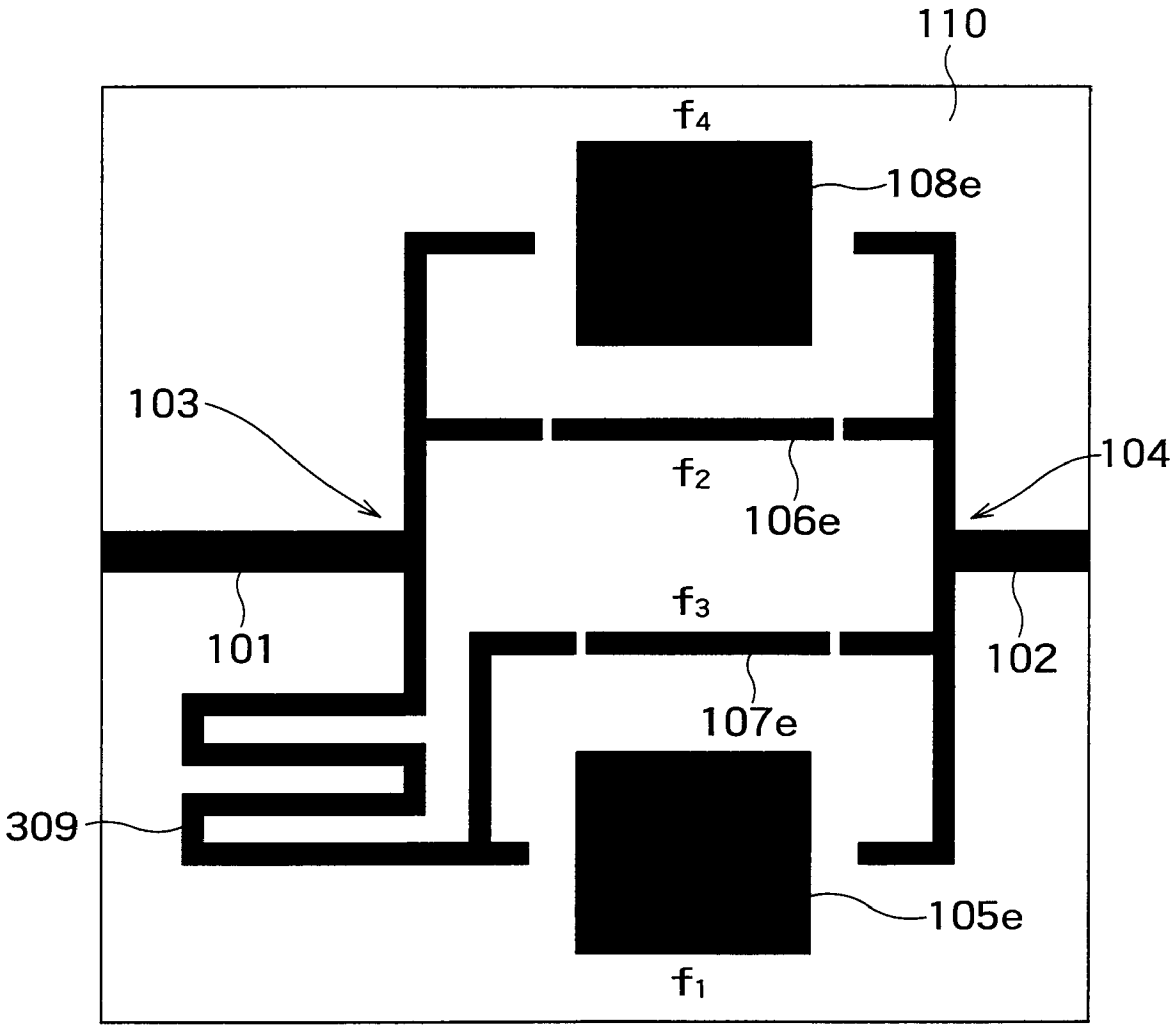
FIG. 17 is a plan layout diagram showing a third modification example of the first embodiment.

FIG. 17 shows a third modification example of the filter circuit of the first embodiment.

The line widths of resonators 105*e* and 108*e* located on both sides of the filter band having a large amount of group delay are set to be greater than those of the first embodiment. In this way, a filter circuit having higher power handling capability is realized. The line widths of resonators 106*e* and 107*e* located at the center side of the filter band are the same as those of the first embodiment. Furthermore, a delay circuit 309 is interposed between an input line 101 and the resonators 105*e* and 107*e* in this modification example. In this way, a delay circuit may be arranged on any one of the input side and the output side of the resonator.

Figure 18:
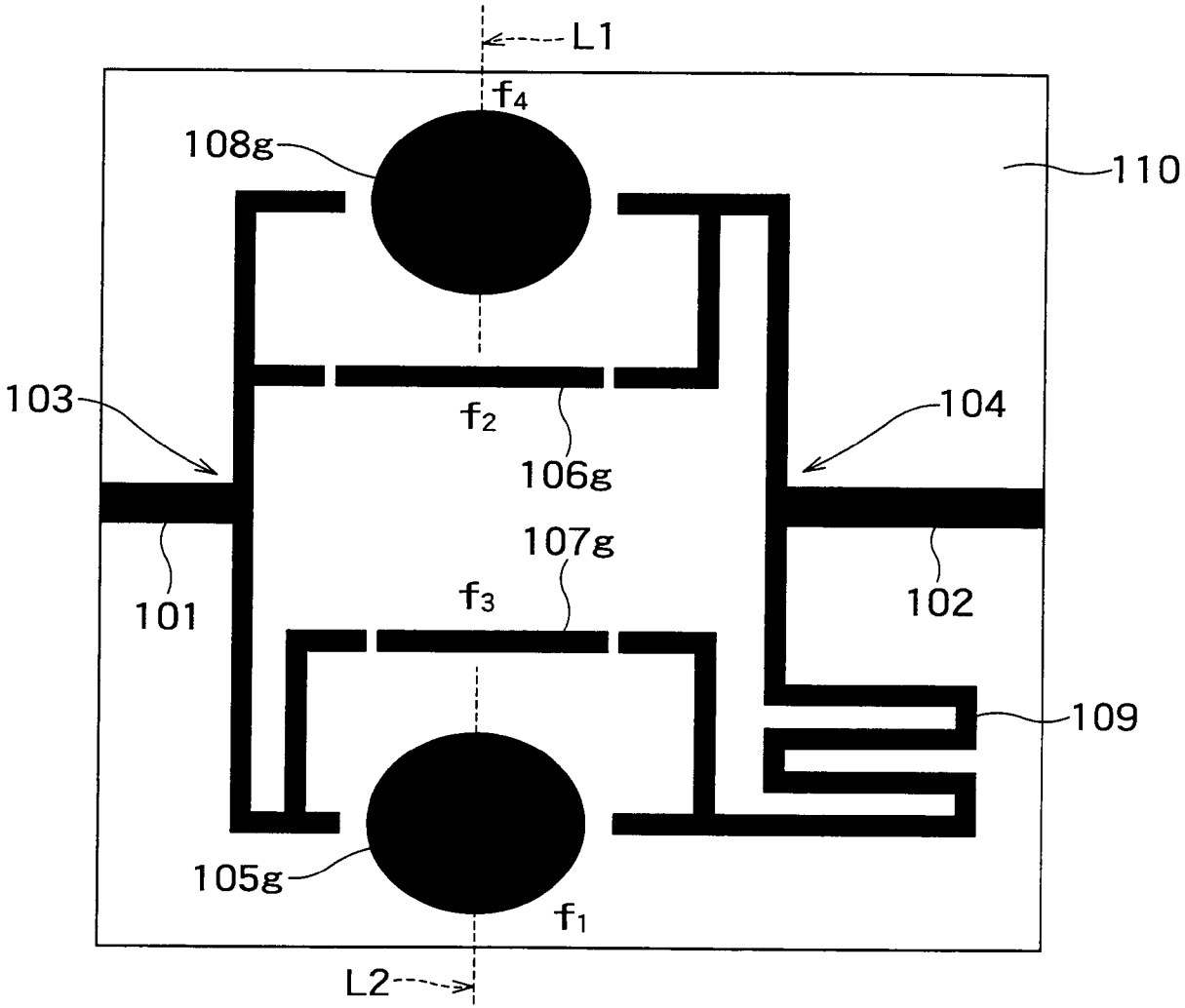
FIG. 18 is a plan layout diagram showing a fourth modification example of the first embodiment.

FIG. 18 shows a fourth modification example of the filter circuit of the first embodiment.

Resonators 105*g*, 106*g*, 107*g* and 108*g* are provided, and where resonators 105*g* and 108*g*, located on both sides of the filter band having a large amount of group delay, correspond to a strip conductor in a microstrip line having a length of half wavelength which is made wider from both sides toward the center and have a substantially circular planar shape here. The resonance mode includes TM011 mode or TM010 mode. Current concentrates more on parts which are closer to the center of the half wavelength. In this example, current concentrates most on the parts indicated by L1 and L2. Therefore, by increasing the line width for parts which are closer to the center of the half wavelength, that is, by changing the line width according to the degree of concentration of current, it is possible to realize high power handling capability and reduce the area occupied by the resonator. In the case of a resonator having a multi-wavelength structure (half wavelength×n (n is an integer equal to or greater than 2), since current is more concentrated on parts closer to the center of each half wavelength, it is possible to realize high power handling capability and reduce the area occupied by the resonator by widening the line width from both ends of the length of half wavelength toward the center.

Figure 19:
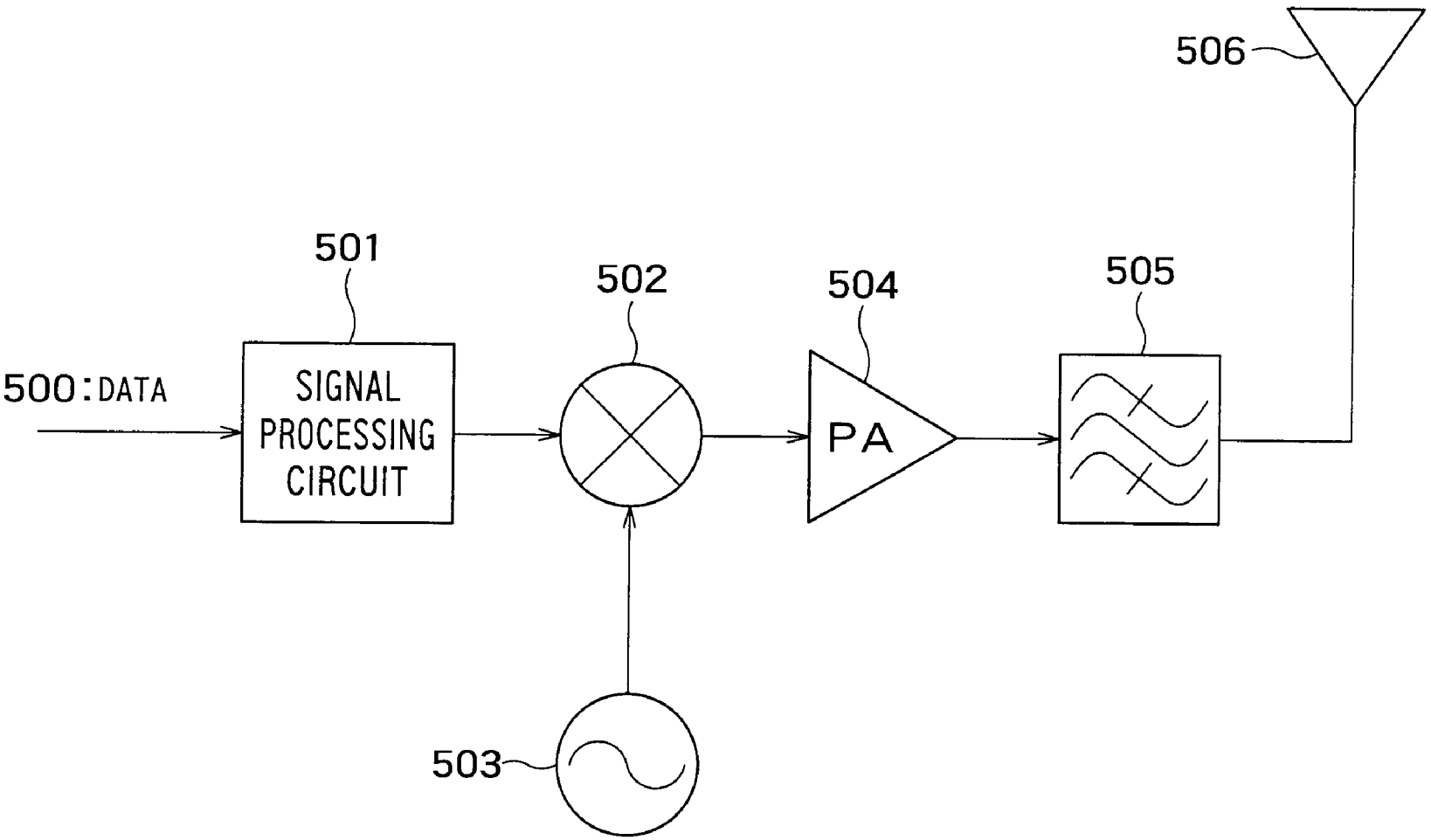
FIG. 19 is a configuration diagram schematically showing an example of a radio communication apparatus.

FIG. 19 schematically shows the configuration of a radio communication apparatus as an embodiment of the present invention. More specifically, the configuration of a transmission unit of a radio communication apparatus is schematically shown.

Data 500 to be transmitted is inputted to a signal processing circuit 501, subjected to processing such as a digital/analog conversion, coding and modulation and a transmission signal of a baseband or an intermediate frequency (IF) band is generated.

The transmission signal from the signal processing circuit 501 is inputted to a frequency converter (mixer) 502 and multiplied by a local signal from a local signal generator 503 and thereby converted to a signal of a radio frequency (RF) band, that is, up-converted.

The RF signal outputted from the mixer 502 is amplified by power amplifier (PA) 504 and then inputted to a band limiting filter (transmission filter) 505. As the band limiting filter 505, the filter circuit explained so far can be used. The signal whose band is limited by this band limiting filter 505 and whose unnecessary frequency component has been removed is supplied to an antenna 506 and is radiated out into space as a radio wave.

What is claimed is:

1. A filter circuit comprising:

an input terminal configured to input an input signal;

first to ith blocks which respectively have first to ith resonators as transmission lines having corresponding first to ith resonance frequencies (first resonance frequency<second resonance frequency < . . . <ith resonance frequency);

a power divider configured to distribute the input signal to the first to ith blocks;

a power combiner configured to combine signals which have passed through the first to ith blocks to obtain a combined signal; and an output terminal configured to output the combined signal, wherein a jth block (j is an integer between 1 and i−1) includes a phase adjustment unit which provides a signal of the jth block with a phase difference within a range of {(180±30)+(360×n)} degrees (n is an integer equal to or greater than 0) from a signal of a (j+1)th block, and a resonator having a large amount of group delay has a greater line width than a resonator having a small amount of group delay, the resonator having a large amount of group delay being any one of the first to ith resonators and the resonator having a small amount of group delay being different from any one of the first to ith resonators.

2. The filter circuit according to claim 1, wherein a total coupling amount of the resonator having a large amount of group delay with a circuit coupled therewith on an input side of the resonator and coupling amount with a circuit coupled therewith on an output side of the resonator is smaller than a total of coupling amount of the resonator having a small amount of group delay with a circuit coupled therewith on an input side of the resonator and coupling amount with a circuit coupled therewith on an output side of the resonator.

3. The filter circuit according to claim 1, wherein conductor parts of the transmission lines are comprised of a superconductor.

4. The filter circuit according to claim 1, wherein a line length of the resonator having a large amount of group delay is n (n is an integer equal to or greater than 1) times a half wavelength at the resonance frequency of the resonator and a line width of the resonator increases from both ends of the length of the half wavelength toward a center of the length of the half wavelength.

5. The filter circuit according to claim 1, wherein each of the transmission lines is a microstrip line.

* * * * *